US011412607B2

(12) United States Patent
Hata et al.

(10) Patent No.: US 11,412,607 B2
(45) Date of Patent: Aug. 9, 2022

(54) ATOMIC BEAM GENERATOR, BONDING APPARATUS, SURFACE MODIFICATION METHOD, AND BONDING METHOD

(71) Applicants: National University Corporation Tokai National Higher Education and Research System, Nagoya (JP); NGK Insulators, Ltd., Nagoya (JP)

(72) Inventors: Seiichi Hata, Nagoya (JP); Junpei Sakurai, Nagoya (JP); Yuuki Hirai, Nagoya (JP); Hiroyuki Tsuji, Nagoya (JP); Takayoshi Akao, Kasugai (JP); Tomoki Nagae, Nagoya (JP); Tomonori Takahashi, Chita (JP)

(73) Assignees: National University Corporation Tokai National Higher Education and Research System, Nagoya (JP); NGK Insulators, Ltd., Nagoya (JP)

( * ) Notice: Subject to any disclaimer, the term of this patent is extended or adjusted under 35 U.S.C. 154(b) by 108 days.

(21) Appl. No.: 17/072,361

(22) Filed: Oct. 16, 2020

(65) Prior Publication Data

US 2021/0037637 A1 Feb. 4, 2021

Related U.S. Application Data

(63) Continuation of application No. PCT/JP2019/008338, filed on Mar. 4, 2019.

(30) Foreign Application Priority Data

Apr. 26, 2018 (JP) ..... JP2018-084961

(51) Int. Cl.
*H05H 3/02* (2006.01)
*H05H 1/46* (2006.01)
(Continued)

(52) U.S. Cl.
CPC ..... *H05H 3/02* (2013.01); *H05H 1/02* (2013.01); *H05H 1/40* (2013.01); *H05H 1/46* (2013.01); *H05H 1/3452* (2021.05)

(58) Field of Classification Search
CPC ..... H05H 3/02; H05H 1/46; H05H 1/3452; H05H 1/48; H05H 1/02; H05H 1/40; G21K 1/14
(Continued)

(56) References Cited

U.S. PATENT DOCUMENTS 6,094,012 A * 7/2000 Leung ..... H01J 27/18 315/111.81
2004/0104682 A1* 6/2004 Horsky ..... H01L 21/26513 315/111.81
2017/0154697 A1 6/2017 Tsuji et al.

FOREIGN PATENT DOCUMENTS

CN 106664790 A 5/2017
JP S61-183898 A1 8/1986
(Continued)

OTHER PUBLICATIONS

Fusao Shimokawa, et al., "Energy Distribution and Information Mechanism of Fast Atoms in a Fast Atom Beam," *Journal of Applied Physics*, vol. 72, No. 13, Jul. 1, 1992, pp. 13-17.
(Continued)

*Primary Examiner* — Kiet T Nguyen
(74) *Attorney, Agent, or Firm* — Burr & Brown, PLLC

(57) ABSTRACT

An atomic beam generator includes a cathode constituted as a housing having an emission surface provided with an irradiation port through which an atomic beam is emissive; an anode disposed inside the cathode to generate plasma between the cathode and the anode; and a magnetic field generating unit including a first magnetic field generating unit that generates a first magnetic field and a second magnetic field generating unit that generates a second mag-
(Continued)

netic field, and guiding positive ions produced in the cathode to the emission surface by generating, in the cathode, the first magnetic field and the second magnetic field both parallel to the emission surface such that a magnetic field direction is leftward in the first magnetic field and is rightward in the second magnetic field when viewed from an emission surface side on condition of the first magnetic field being positioned above the second magnetic field.

13 Claims, 14 Drawing Sheets

(51) Int. Cl.
*H05H 1/02* (2006.01)
*H05H 1/40* (2006.01)
*H05H 1/34* (2006.01)

(58) Field of Classification Search
USPC ..... 250/251, 396 ML
See application file for complete search history.

(56) References Cited

FOREIGN PATENT DOCUMENTS

| | | | |
|---|---|---|---|
| JP | S61-183900 | A | 8/1986 |
| JP | S62-180942 | A1 | 8/1987 |
| JP | 2001-216907 | A1 | 8/2001 |
| JP | 2001-289982 | A | 10/2001 |
| JP | 2008-281346 | A1 | 11/2008 |
| JP | 2012-146424 | A1 | 8/2012 |
| JP | 2016-141825 | A | 8/2016 |
| WO | 2017/03 8476 | A1 | 3/2017 |

OTHER PUBLICATIONS

International Search Report and Written Opinion (Application No. PCT/JP2019/008338) dated May 28, 2019.
English translation of the International Preliminary Report on Patentability (Chapter I) (Application No. PCT/JP2019/008338) dated Nov. 5, 2020.
Chinese Office Action, Chinese Application No. 201980028445.1 dated May 11, 2022 (14 pages).

* cited by examiner

| | | Anode Spacing P (mm) | | |
|---|---|---|---|---|
| | | 1mm | 18mm | 32mm |
| Yoke Position Q (mm) | −15mm | EXAMPLE 2 | EXAMPLE 3 | EXAMPLE 4 |
| | 0mm | EXAMPLE 5 | EXAMPLE 6 | EXAMPLE 7 |
| | +15mm | EXAMPLE 8 | EXAMPLE 9 | EXAMPLE 10 |

Explanatory view indicating the anode spacing P and the yoke position Q

Fig. 15

| | | Anode Spacing P (mm) | | |
|---|---|---|---|---|
| | | 1mm | 18mm | 32mm |
| Yoke Position Q (mm) | −15mm | EXAMPLE 2<br>Maximum Depth 150.7 nm | EXAMPLE 3<br>Maximum Depth 132.8 nm | EXAMPLE 4<br>Maximum Depth 67.8 nm |
| | 0mm | EXAMPLE 5<br>Maximum Depth 66.3 nm | EXAMPLE 6<br>Maximum Depth 40.9 nm | EXAMPLE 7<br>Maximum Depth 27.2 nm |
| | +15mm | EXAMPLE 8<br>Maximum Depth 62.5 nm | EXAMPLE 9<br>Maximum Depth 95.5 nm | EXAMPLE 10<br>Maximum Depth 29.0 nm |

Explanatory view indicating the anode spacing P and the yoke position Q

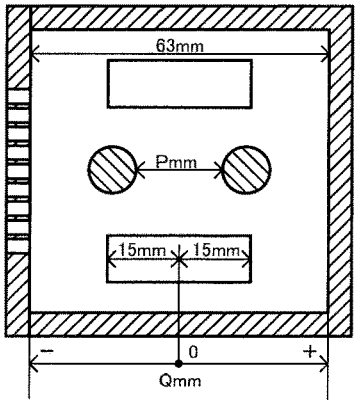

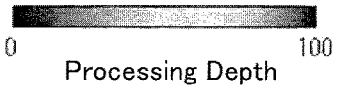

Fig. 16

| | | Anode Spacing P (mm) | | |
|---|---|---|---|---|
| | | 1mm | 18mm | 32mm |
| Yoke Position Q (mm) | −15mm | EXAMPLE 2 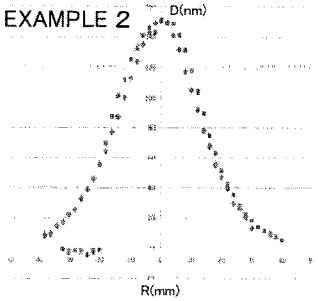 Maximum Depth 150.7 nm | EXAMPLE 3 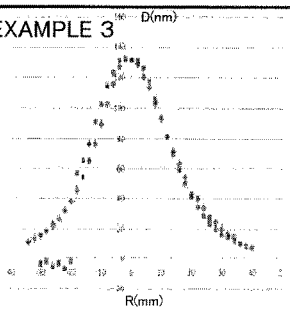 Maximum Depth 132.8 nm | EXAMPLE 4 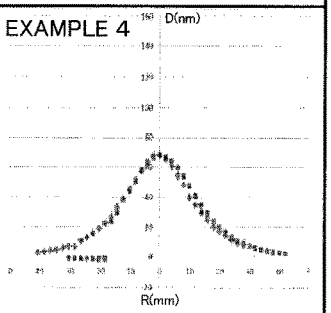 Maximum Depth 67.8 nm |
| | 0mm | EXAMPLE 5 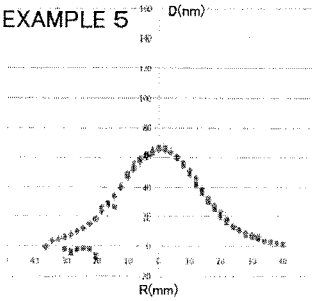 Maximum Depth 66.3 nm | EXAMPLE 6 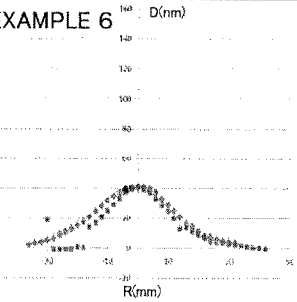 Maximum Depth 40.9 nm | EXAMPLE 7 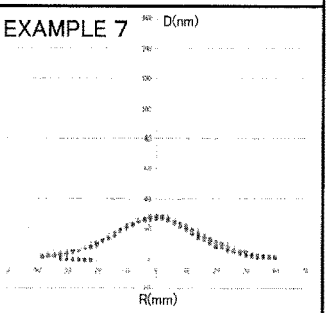 Maximum Depth 27.2 nm |
| | +15mm | EXAMPLE 8 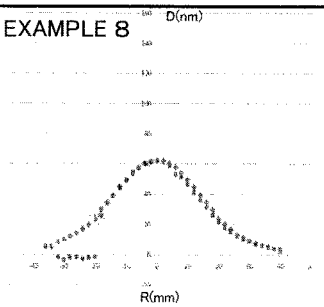 Maximum Depth 62.5 nm | EXAMPLE 9 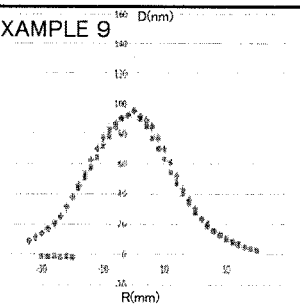 Maximum Depth 95.5 nm | EXAMPLE 10 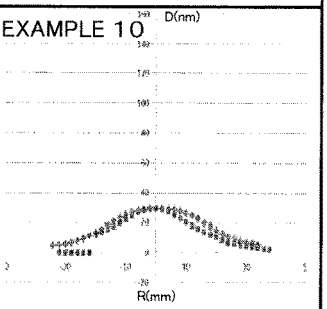 Maximum Depth 29.0 nm |

Explanatory view indicating the anode spacing P and the yoke position Q

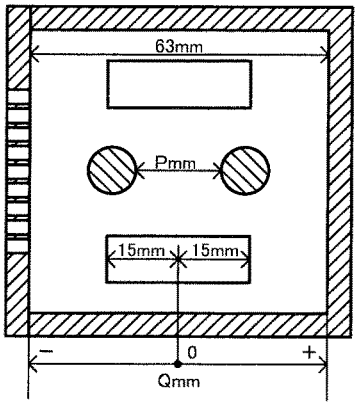

Explanatory view of measured section

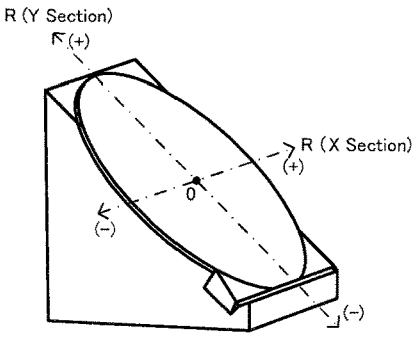

ATOMIC BEAM GENERATOR, BONDING APPARATUS, SURFACE MODIFICATION METHOD, AND BONDING METHOD

BACKGROUND OF THE INVENTION

1. Field of the Invention

The present invention relates to an atomic beam generator, a bonding apparatus, a surface modification method, and a bonding method.

2. Description of the Related Art

An atomic beam generator including a cathode which serves also as a housing and an anode disposed inside the cathode is widely known so far. In that type of atomic beam generator, plasma is generated by introducing rarefied gas, and by applying a voltage between the cathode and the anode to form a discharge space. Gas ions produced in the plasma are accelerated by an electric field. Of the produced gas ions, those ions moving toward an irradiation port formed in part of the housing are neutralized by receiving electrons from a wall of the irradiation port, and are emitted as an atomic beam from the irradiation port. In relation to the above-described atomic beam generator, there is proposed, for example, a technique of disposing two rod-shaped anodes inside a cylindrical cathode with an irradiation port formed in its end surface, the two anodes being parallel to a center axis of the cathode, and applying a magnetic field around the cathode perpendicularly to the center axis (see Patent Literature (PTL) 1). According to PTL 1, electrons emitted from the cathode are forced to oscillate around the anodes between opposing portions of the cathode, and to collide with many gas molecules during the oscillation, thus generating ions. Furthermore, because the electrons in the discharge space make spiral motions in such a way as tangling with lines of magnetic force, the effective ranges of the electrons are increased and a large amount of ions are produced in the discharge space by collision with the gas molecules. As another example, it is also proposed to coaxially place an annular anode in a cylindrical cathode having an irradiation port formed in its end surface, and to apply a magnetic field along an axis of the cathode (see Non Patent Literature (NPL) 1). According to NPL 1, because the electrons make spiral motions around the axis while receiving the magnetic field along the axis, the electrons are forced to move through larger distances and to collide with the gas molecules, whereby a large amount of positive ions are produced. These positive ions are accelerated toward the cathode, and many of the positive ions become fast atoms.

CITATION LIST

Patent Literature

PTL 1: JP 62-180942
NPL 1: J. Appl. Phys. 72(1), 1 Jul. 1992, pp 13-17

SUMMARY OF THE INVENTION

However, the atomic beam generators disclosed in PTL 1 and NPL 1 have the following problem in spite of that the large amount of positive ions are produced. Because the generated positive ions are accelerated toward the cathode in all directions, considerable part of the positive ions does not move toward the irradiation port and the number of atoms emitted from the irradiation port is not sufficient in some cases. For that reason, there has been a demand for a technique capable of emitting of the atoms in larger number.

The present invention has been made with intent to solve the above-mentioned problem, and a main object of the present invention is to emit a larger number of atoms in an atomic beam generator.

The present invention provides an atomic beam generator including:

a cathode constituted as a housing having an emission surface provided with an irradiation port through which an atomic beam is emissive;

an anode disposed inside the cathode to generate plasma between the cathode and the anode; and a magnetic field generating unit including a first magnetic field generating unit that generates a first magnetic field and a second magnetic field generating unit that generates a second magnetic field, and guiding positive ions produced in the cathode to the emission surface by generating, in the cathode, the first magnetic field and the second magnetic field both parallel to the emission surface such that a magnetic field direction is leftward in the first magnetic field and is rightward in the second magnetic field when viewed from an emission surface side on condition of the first magnetic field being positioned above the second magnetic field.

According to the above-described atomic beam generator, since the first magnetic field and the second magnetic field being parallel to the emission surface and oriented in the predetermined directions are generated, electrons generated at the cathode constituted as the housing and moving toward the anode along paths substantially parallel to the emission surface are caused to move toward the emission surface by receiving the Lorentz force under the actions of the magnetic fields. The positive ions are attracted by charges of those electrons and are guided to the emission surface. Eventually, a larger number of atoms can be emitted from the irradiation port. In this Description, the term "magnetic field parallel to the emission surface" includes not only a magnetic field perfectly parallel to the emission surface, but also a magnetic field that is substantially parallel to the emission surface and is deviated from a perfectly parallel relation within such an extent as enabling the electrons generated at the cathode and moving toward the anode to be bent by the action of the magnetic field to move toward the emission surface. Furthermore, the term "rightward magnetic field" refers to a magnetic field having a rightward component and includes not only a magnetic field that has a rightward component alone and is perfectly rightward, but also a magnetic field that includes upward and downward components in addition to the rightward component. The rightward magnetic field includes, for example, a substantially rightward magnetic field, a magnetic field inclined within a range of ±45° relatively to the perfectly rightward magnetic field, and so on. The above point is similarly applied to the term "leftward magnetic field". Moreover, the first magnetic field may be defined as a magnetic field that is parallel to the emission surface at least in a region between an N pole and an S pole of the first magnetic field generating unit, and that is oriented in a predetermined direction. Similarly, the second magnetic field may be defined as a magnetic field that is parallel to the emission surface at least in a region between an N pole and an S pole of the second magnetic field generating unit, and that is oriented in a predetermined direction.

In the atomic beam generator according to the present invention, the magnetic field generating unit may generate the first magnetic field and the second magnetic field at positions away from the anode in a sandwiching relation to the anode when viewed from the emission surface side. With this feature, the electrons emitted at opposing portions of the cathode sandwiching the anode can be forced to move toward the emission surface by the actions of the magnetic fields, and hence the number of the atoms emitted from the irradiation port can be further increased.

In the atomic beam generator according to the present invention, the magnetic field generating unit may be disposed within an inner space of the cathode at a position closer to the emission surface. With this feature, the number of the atoms emitted from the irradiation port can be further increased.

In the atomic beam generator according to the present invention, the anode may be disposed plane-symmetrically with respect to a predetermined imaginary plane perpendicular to the emission surface, and the magnetic field generating unit may generate the first magnetic field and the second magnetic field in a sandwiching relation to the imaginary plane. In the cathode, for all magnetic field vectors when viewed from the emission surface side on condition of the first magnetic field being positioned above the second magnetic field, components parallel to the emission surface may be leftward on the side above the imaginary plane and rightward on the side below the imaginary plane.

In the atomic beam generator according to the present invention, the anode may include a rod-shaped first anode and a rod-shaped second anode, and axes of the first anode and the second anode may be parallel to the imaginary plane. With this feature, larger part of the electrons moving from the cathode toward the anode along the paths substantially parallel to the emission surface enters the first magnetic field and the second magnetic field, and hence a larger number of the electrons can be moved toward the emission surface.

In the atomic beam generator according to the present invention, the first anode and the second anode may be disposed with the axes positioned on the imaginary plane. With this feature, the electrons are moved toward the first anode from opposing portions of the cathode on both the sides of the first anode, and the electrons are moved toward the second anode from opposing portions of the cathode on both the sides of the second anode. As a result, a larger number of the electrons can be caused to enter the first magnetic field and the second magnetic field.

In the atomic beam generator according to the present invention, the axes of the first anode and the second anode may be parallel to the emission surface.

In the atomic beam generator according to the present invention, the irradiation port may be provided at a position intersected by the imaginary plane. With this feature, the positive ions guided to the emission surface by the action of the first magnetic field and the positive ions guided to the emission surface by the action of the second magnetic field are both guided to the vicinity of the irradiation port. Accordingly, a larger number of the atoms can be emitted from the irradiation ports.

In the atomic beam generator according to the present invention, when viewed from the emission surface side, the irradiation port may be provided between a linear line connecting an N pole of the first magnetic field generating unit and an S pole of the second magnetic field generating unit and a linear line connecting an S pole of the first magnetic field generating unit and an N pole of the second magnetic field generating unit. It is inferred that a larger number of the positive ions are guided to such a region by the actions of the first magnetic field and the second magnetic field, and hence that a larger number of the atoms can be emitted from the irradiation port with the arrangement in which the irradiation port is provided in the above-mentioned region.

In the atomic beam generator according to the present invention, the anode may include a rod-shaped first anode disposed at a position away from the emission surface and a rod-shaped second anode disposed at a position further away from the emission surface. With this feature, a proportion of the electrons moving from the cathode toward the anode along the paths substantially parallel to the emission surface can be increased, and hence the number of the atoms emitted from the irradiation port can be further increased.

A bonding apparatus according to the present invention includes the above-described atomic beam generator. The bonding apparatus can perform bonding in a shorter time because the number of the atoms emitted from the irradiation port of the atomic beam generator can be further increased.

A surface modification method carried out using an atomic beam generator including:

a cathode constituted as a housing having an emission surface provided with an irradiation port through which an atomic beam is emissive; and an anode disposed inside the cathode to generate plasma between the cathode and the anode, wherein the surface modification method modifies a surface of an irradiation target by irradiating the irradiation target with the atomic beam in a state in which a first magnetic field and a second magnetic field both parallel to the emission surface are generated in the cathode such that, in order to guide positive ions produced in the cathode to the emission surface, a magnetic field direction is leftward in the first magnetic field and is rightward in the second magnetic field when viewed from the emission surface side on condition of the first magnetic field being positioned above the second magnetic field.

With the above-described surface modification method, since the first magnetic field and the second magnetic field being parallel to the emission surface of the atomic beam generator and oriented in the predetermined directions are generated, electrons generated at the cathode constituted as the housing and moving toward the anode along paths substantially parallel to the emission surface are caused to move toward the emission surface by receiving the Lorentz force under the actions of the magnetic fields. The positive ions are attracted by charges of those electrons and are guided to the emission surface. Eventually, a larger number of atoms can be emitted from the irradiation port. Hence the surface of the irradiation target can be modified in a shorter time. The modification includes, for example, cleaning, activation, conversion to an amorphous state, and removal.

A bonding method according to the present invention includes steps of modifying surfaces of a first member and a second member, each being the irradiation target, by the above-described surface modification method, and bonding the first member and the second member by bringing the modified surfaces into contact with each other. With the above-described bonding method, since the surfaces of the first member and the second member can be modified in a shorter time, the first member and the second member can be bonded to each other with higher efficiency.

BRIEF DESCRIPTION OF THE DRAWINGS

FIG. 15 illustrates distributions of a processing depth of a wafer W in EXAMPLES 2 to 10.

FIG. 16 plots graphs representing the processing depth of the wafer W in EXAMPLES 2 to 10.

DETAILED DESCRIPTION OF THE INVENTION

A preferred embodiment of the present invention will be described below with reference to the drawings.

[Atomic Beam Generator]

Figure 1:
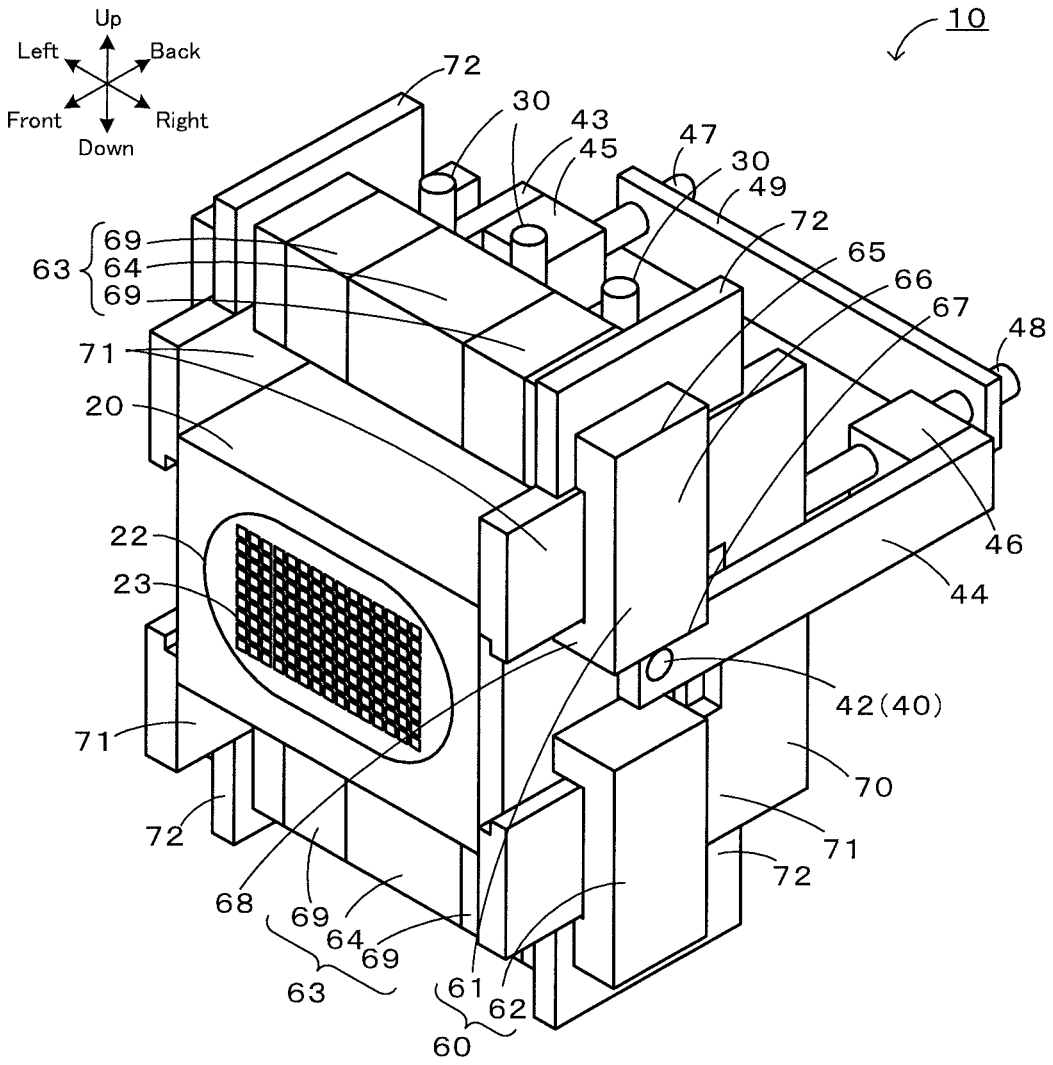
FIG. 1 is a schematic perspective view illustrating a structure of an atomic beam generator 10.
Figure 2:
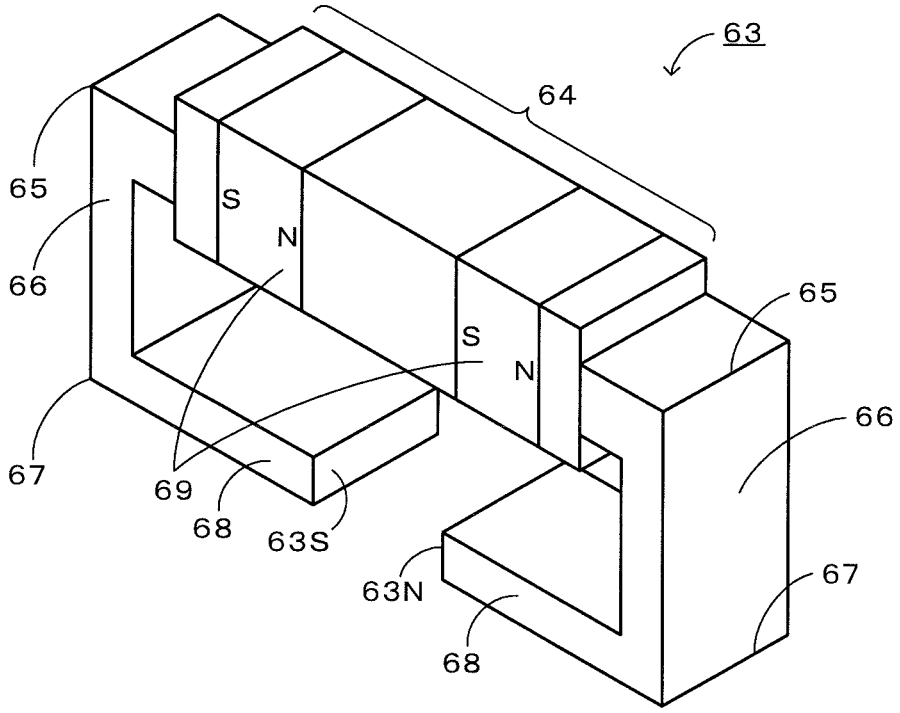
FIG. 2 is a schematic perspective view illustrating a structure of a yoke 63.
Figure 3:
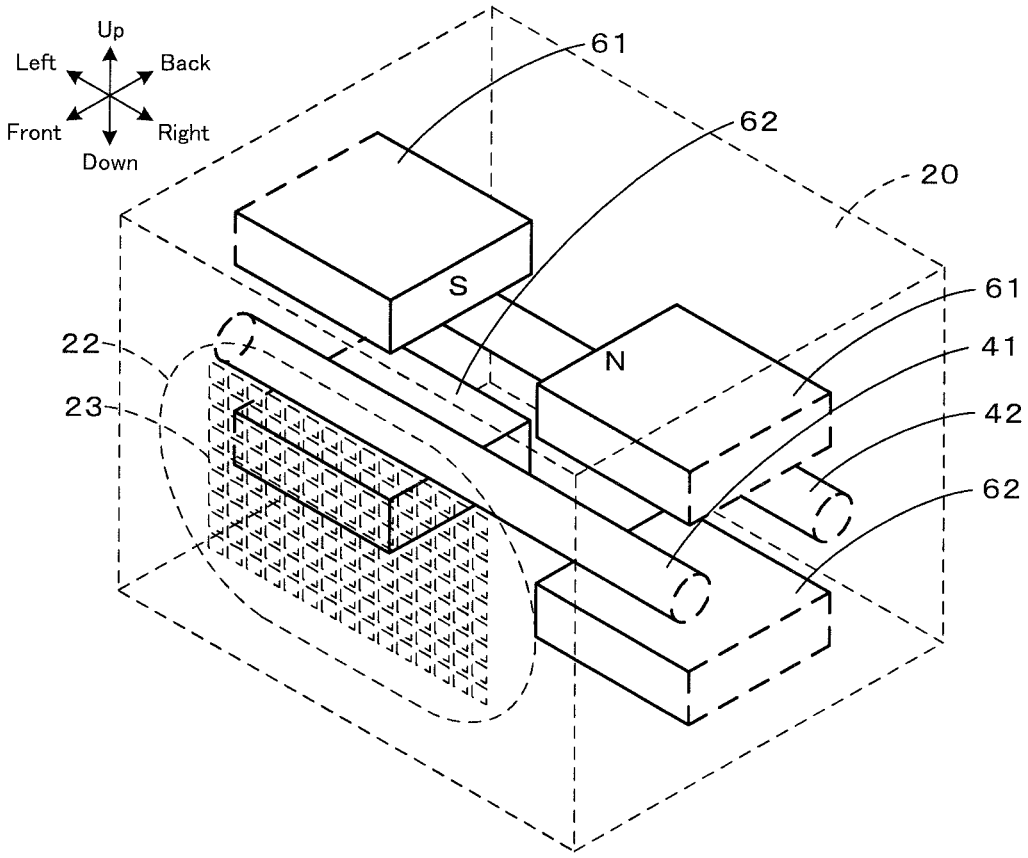
FIG. 3 is a schematic perspective view illustrating an internal structure of a cathode 20.
Figure 4:
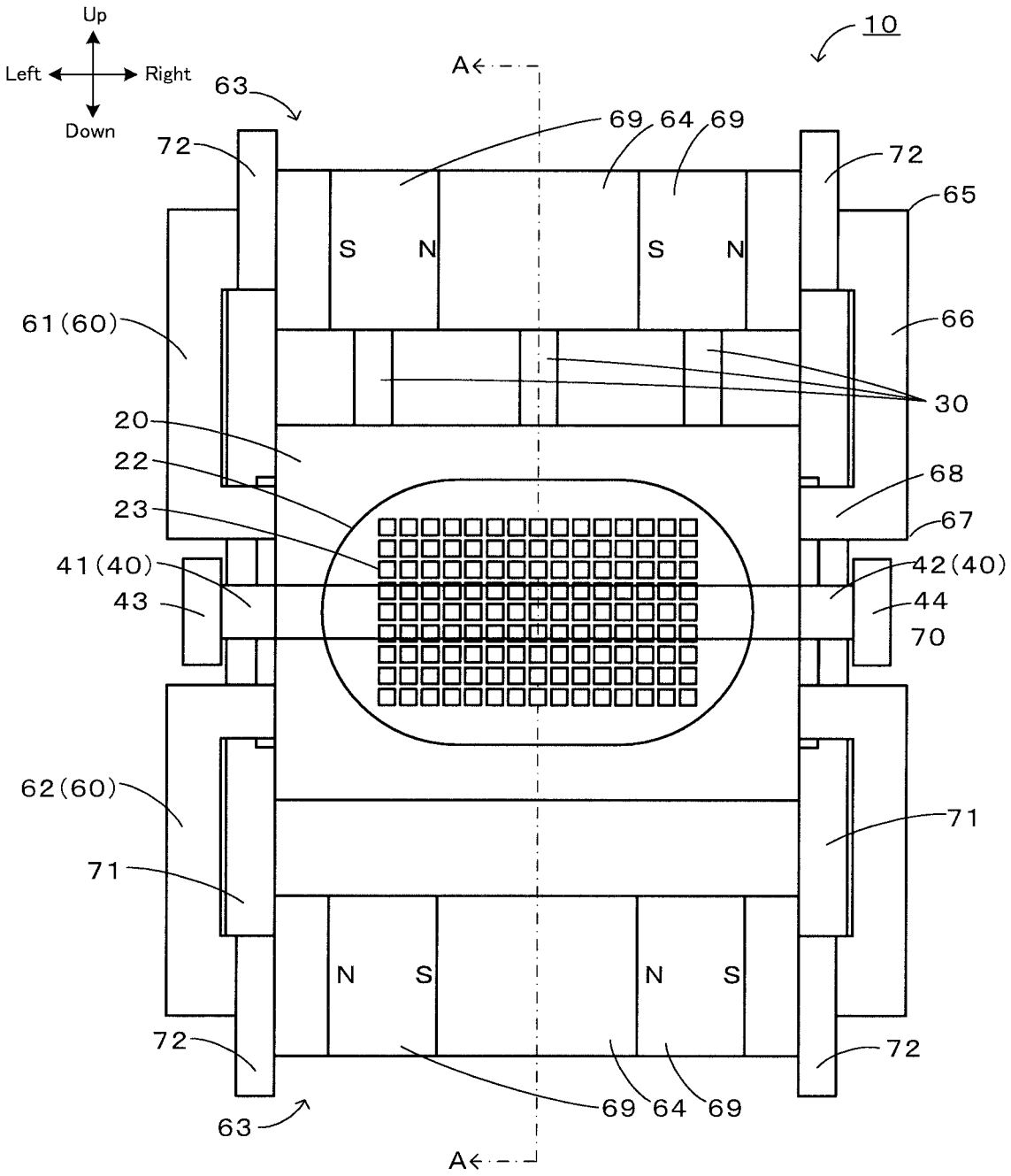
FIG. 4 is a schematic front view illustrating the structure of the atomic beam generator 10.
Figure 5:
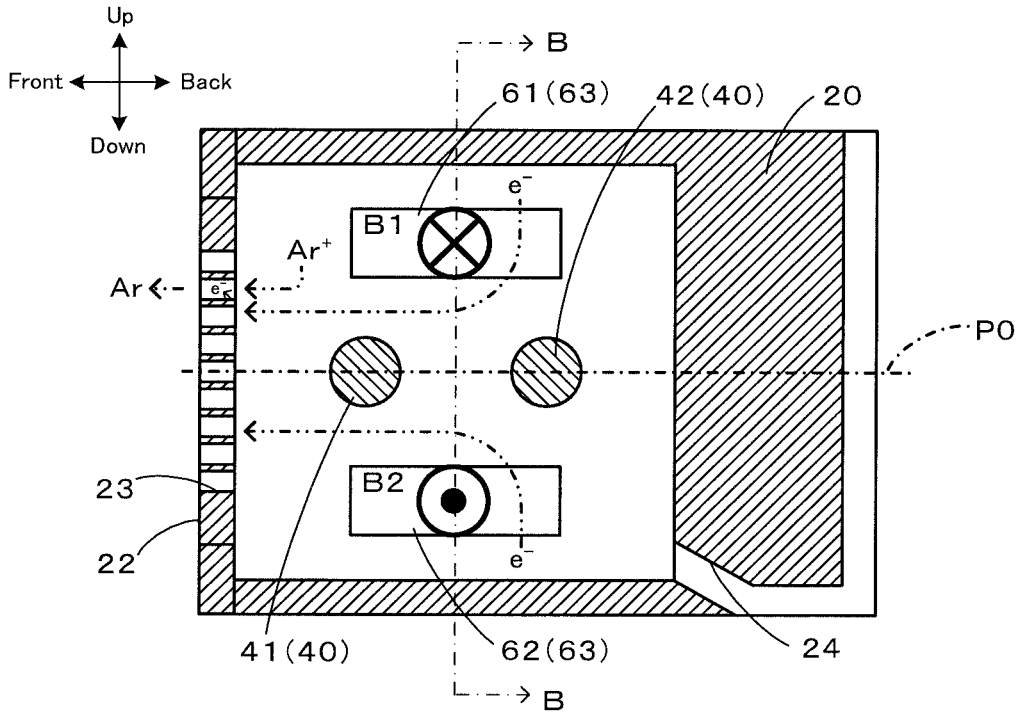
FIG. 5 is a sectional view taken along A-A in FIG. 4 (the view illustrating only the cathode 20 and the inside thereof).
Figure 6:
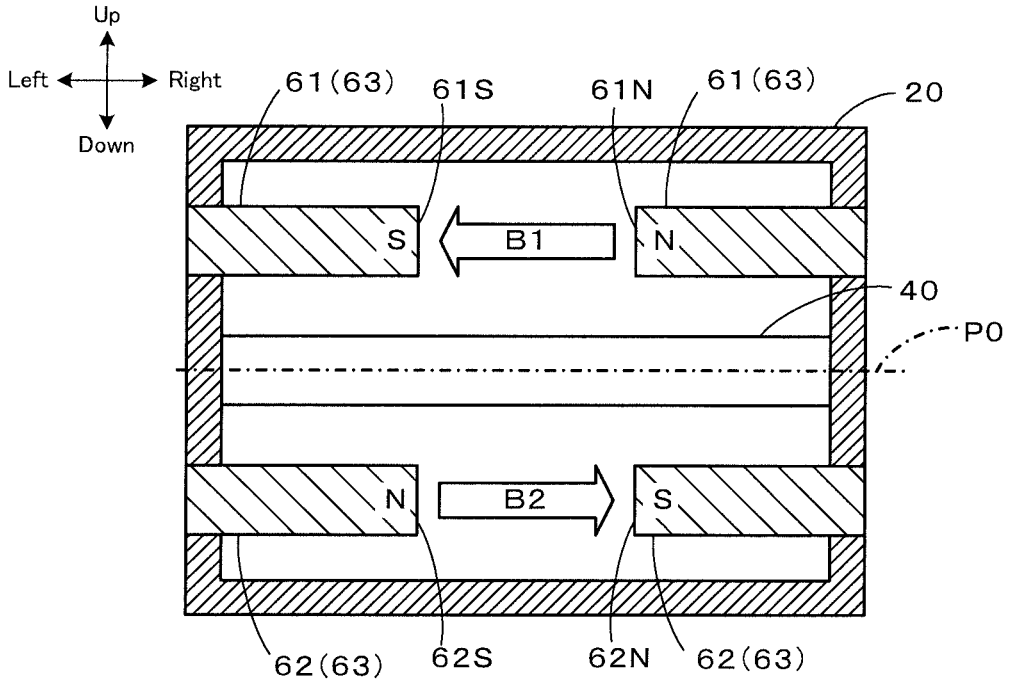
FIG. 6 is a sectional view taken along B-B in FIG. 5, the view illustrating the cathode 20 and the inside thereof.

FIG. 1 is a schematic perspective view illustrating a structure of an atomic beam generator 10, FIG. 2 is a schematic perspective view illustrating a structure of a yoke 63, and FIG. 3 is a schematic perspective view illustrating an internal structure of a cathode 20. In FIG. 3, an inner wall surface of the cathode 20 and portions present in the inner wall surface of the cathode 20 are denoted by dashed lines. FIG. 4 is a schematic front view illustrating the structure of the atomic beam generator 10, FIG. 5 is a sectional view taken along A-A in FIG. 4 (the view illustrating only the cathode 20 and the inside thereof), and FIG. 6 is a sectional view taken along B-B in FIG. 5, the view illustrating the cathode 20 and the inside thereof. In this embodiment, left and right directions, front and back directions, and up and down directions are defined as per denoted in FIG. 1.

The atomic beam generator 10 includes the cathode 20 constituted as a housing, an anode 40 disposed inside the cathode 20, and a magnetic field generating unit 60 that generates a magnetic field in the cathode 20. The atomic beam generator 10 is used as, for example, a fast-atom beam gun (FAB gun).

The cathode 20 generates plasma between the anode 40 and the cathode 20, and is connected to the lower potential side (ground side) of a not-illustrated DC power supply. The cathode 20 is a box-shaped member having an emission surface 22 provided with irradiation ports 23 through each of which an atomic beam is emissive. The plasma is generated inside the cathode 20. The cathode 20 is constituted by a water cooled jacket made of a metal and lined with a carbon material. A gas inlet 24 connected to gas pipes 30 is provided in the cathode 20, and gas (for example, argon gas) necessary for generating the plasma is introduced into the cathode 20 through the gas inlet 24. The irradiation ports 23 are through-holes penetrating through a wall of the cathode 20 where the emission surface 22 is defined. The size, number and arrangement of the irradiation ports 23 are set such that pressure (gas pressure) within the cathode 20 can be held at the pressure required to generate the stable plasma, and that a desired amount of atomic beam can be bombarded to a desired region.

The anode 40 is disposed inside the cathode 20 to generate the plasma between the cathode 20 and the anode 40, and is connected to the higher potential side of the not-illustrated DC power supply. The anode 40 is constituted by a rod-shaped first anode 41 disposed at a position away from the emission surface 22, and a rod-shaped second anode 42 disposed at a position further away from the emission surface 22. The first and second anodes 41 and 42 are fixed in cantilever fashion to support members 43 and 44, respectively, both disposed outside the cathode 20, and are inserted to the inside of the cathode 20 via not-illustrated through-openings that are formed in the wall of the cathode 20. The through-openings are elongate holes extending in the front-back direction in FIG. 1, and are sealed up by a not-illustrated insulating material after the first and second anodes 41 and 42 have been disposed at predetermined positions inside the cathode 20. Insulation between the first anode 41 and the wall of the cathode 20 and insulation between the second anode 42 and the wall of the cathode 20 are ensured by the above-mentioned insulating material. The support member 43 is fixed to a movable member 45 moving back and forth along a movement shaft 47 that is fixed to a back surface of the cathode 20, and the support member 44 is fixed to a movable member 46 moving back and forth along a movement shaft 48 that is fixed to the back surface of the cathode 20. The positions of the first and second anodes 41 and 42 and the spacing between both the anodes can be changed by moving the movable members 45 and 46 back and forth. The anode is made of a carbon material.

The magnetic field generating unit 60 generates, inside the cathode 20, magnetic fields B1 and B2 parallel to the emission surface 22 in order that positive ions produced in the cathode 20 are guided to the emission surface 22. The magnetic field generating unit 60 includes a first magnetic field generating unit 61 that generates a first magnetic field B1, and a second magnetic field generating unit 62 that generates a second magnetic field B2. The first magnetic field generating unit 61 and the second magnetic field generating unit 62 are constituted by different yokes 63. The magnetic field generating unit 60 generates, in the cathode 20, the magnetic fields B1 and B2 parallel to the emission surface 22 such that a magnetic field direction is leftward in the first magnetic field B1 and is rightward in the second magnetic field B2 when viewed from the side including the emission surface 22 on condition of the first magnetic field B1 being positioned above the second magnetic field B2.

As illustrated in FIG. 2, the yoke 63 includes a main body 64 made of iron, and two permanent magnets 69 made of neodymium and disposed midway the main body 64. The yoke 63 further includes, on both the left and right sides of the main body 64, upper arms 66 perpendicularly bent downward from shoulders 65, and forearms 68 perpendicularly bent forward at elbows 67 from the upper arms 66. Those members are also made of iron like the main body 64. The upper arms 66 are oriented vertically, and the forearms are oriented horizontally. An end portion of one of the forearms 68 serves as an N-pole-side end portion 63N, and an end portion of the other forearm 68 serves as an S-pole-side end portion 63S. Those end portions 63N and 63S are located at the same height (same position in the up-down direction) opposite to each other with a predetermined spacing kept therebetween. The N-pole-side end portion and the S-pole-side end portion of the yoke 63 constituting the first magnetic field generating unit 61 are called respectively an N-pole-side end portion 61N and an S-pole-side end portion 61S. The N-pole-side end portion and the S-pole-side end portion of the yoke 63 constituting the second magnetic field generating unit 62 are called respectively an N-pole-side end portion 62N and an S-pole-side end portion 62S.

The yoke 63 constituting the first magnetic field generating unit 61 is disposed in a state in which the main body 64 is positioned outside and above the cathode 20, and in which the N-pole-side end portion 61N and the S-pole-side end portion 61S are inserted into the cathode 20 from the right side and the left side, respectively. The yoke 63 constituting the second magnetic field generating unit 62 is disposed in a state in which the main body 64 is positioned outside and below the cathode 20, and in which the N-pole-side end portion 62N and the S-pole-side end portion 62S are inserted into the cathode 20 from the left side and the right side, respectively. With such an arrangement, magnetic forces of the permanent magnets 69 disposed outside the cathode 20 can be guided to the inside of the cathode 20. The magnetic fields B1 and B2 straightly going from the N-pole-side end portion toward the S-pole-side end portion are generated in a region between the N-pole-side end portion 61N and the S-pole-side end portion 61S and a region between the N-pole-side end portion 62N and the S-pole-side end portion 62S (see FIGS. 5 and 6).

The first magnetic field generating unit 61 and the second magnetic field generating unit 62 are disposed such that the above-mentioned straight magnetic fields B1 and B2 generated by the yokes 63 are disposed parallel to the emission surface 22 at positions away from the anode 40 in a sandwiching relation to the anode 40 when viewed from the side including the emission surface 22 (see FIG. 6). In addition, an S pole and an N pole are positioned so as to generate the first magnetic field B1 going from the front side facing the drawing sheet of FIG. 5 toward the back side in the first magnetic field generating unit 61, and to generate the second magnetic field B2 going from the back side of the drawing sheet of FIG. 5 toward the front side in the second magnetic field generating unit 62. With such an arrangement, as illustrated in FIG. 5, the Lorentz force acts on electrons emitted from the cathode 20, thus causing the electrons to move toward the emission surface 22 and the irradiation ports 23 formed in the emission surface 22.

Figure 7:
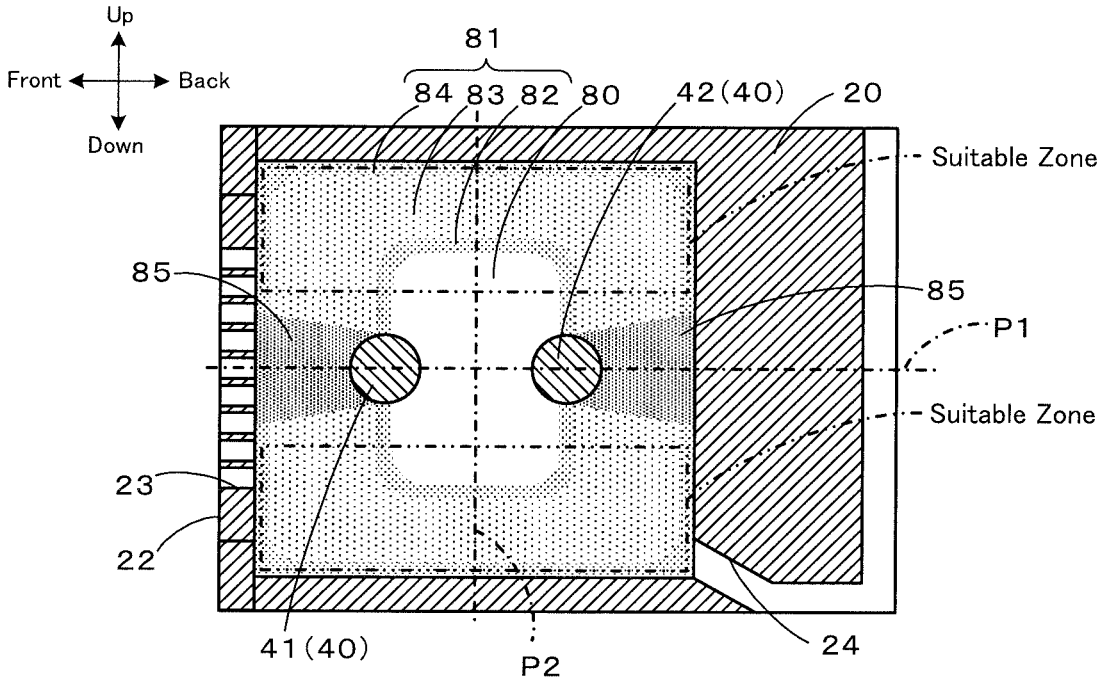
FIG. 7 is an explanatory view referenced to explain a state of plasma when a magnetic field is not applied.

Furthermore, the first magnetic field generating unit 61 and the second magnetic field generating unit 62 are disposed to generate the magnetic fields B1 and B2 parallel to the emission surface 22 in a sheath region 81 (see FIG. 7) that is present between a plasma region 80 in which plasma is generated when no magnetic fields are applied and the wall of the cathode 20. The plasma region 80 and the sheath region 81 are now described with reference to FIG. 7. The plasma generated between the cathode 20 and the anode 40 when no magnetic fields are applied is formed, as illustrated in FIG. 7, symmetrically with respect to not only an imaginary plane P1 including an axis of the first anode 41 and an axis of the second anode 42, but also an imaginary plane P2 that is spaced from the first anode 41 and the second anode 42 through equal distances and are parallel to the emission surface 22. The plasma includes the plasma region 80 and the sheath region 81. The sheath region 81 is a region between the plasma region 80 and the wall of the cathode 20. The sheath region 81 is basically darker than the plasma region. The sheath region 81 is made up of, for example, a first dark zone 82 present around the plasma region 80, a bright zone 83 present around the first dark zone 82 and brighter than the first dark zone 82, and a second dark zone 84 present around the bright zone 83 in some cases and darker than the bright zone 83. The magnetic fields B1 and B2 are preferably applied to zones of the sheath region 81 close to the plasma region 80 and are more preferably applied to, for example, the first dark zone 82 and the bright zone 83. When no magnetic fields are applied, plasma similar to the above-described plasma is also observed in any other section of the inside of the cathode 20, the other section being parallel to the section A-A.

The yoke 63 constituting the first magnetic field generating unit 61 is held by C-shaped members 70 fixed to both left and right ends of the cathode 20 with left and right arm portions 71 on the upper side of the C-shaped members embraced respectively by the left and right arms of the yoke. The yoke 63 constituting the second magnetic field generating unit 62 is held by the C-shaped members 70 fixed to both the left and right ends of the cathode 20 with left and right arm portions 71 on the lower side of the C-shaped members embraced respectively by the left and right arms of the yoke. The C-shaped members 70 are each fixed to the cathode 20 in a state in which the arm portions 71 are oriented horizontally and in which an opening of the C-shape is positioned forward. The yoke 63 is movable in the front-back direction along the arm portions 71 of the C-shaped members. Accordingly, the yoke 63 can be moved to come closer to the emission surface 22 and away from the emission surface 22. After the yoke 63 has been disposed at a desired position, the position of the yoke at that time is fixedly held by fixing members 72.

Figure 9:
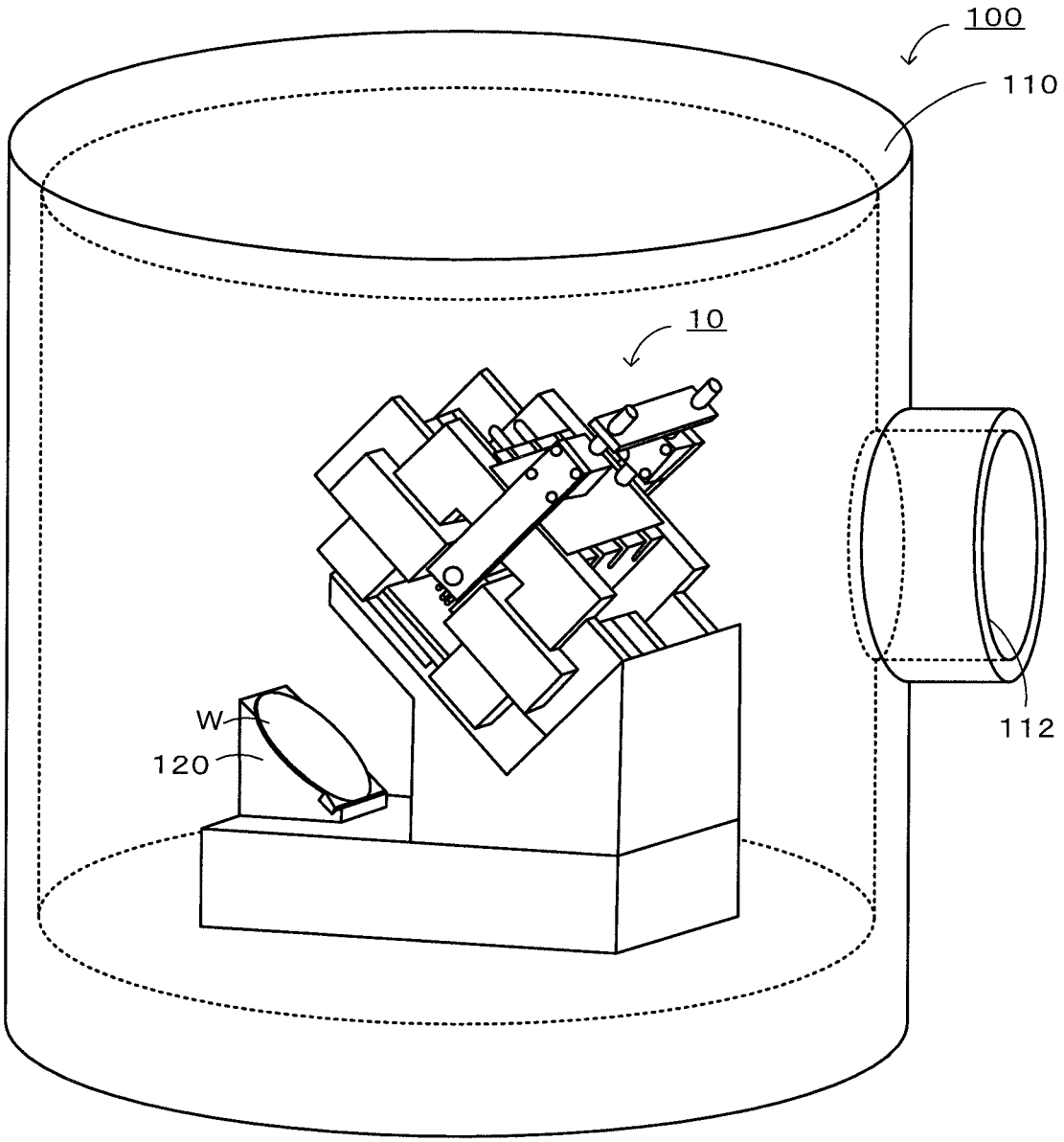
FIG. 9 is a schematic explanatory view illustrating a structure of a surface modification apparatus 100.

A surface modification method of modifying a wafer surface as a target to be processed (namely, a method of producing a surface modified body) with the atomic beam generator 10 will be described below in connection with, for example, the case of using a surface modification apparatus 100. The following description is made regarding the case in which atoms to be bombarded are argon atoms. FIG. 9 is a schematic explanatory view illustrating a structure of the surface modification apparatus 100. The surface modification apparatus 100 includes a chamber 110, a placement stage 120, and the atomic beam generator 10. The chamber 110 is a vacuum container the inside of which is sealed from an environment. The chamber 110 has an evacuation port 112 to which a not-illustrated vacuum pump is connected to discharge gas inside the chamber 110 through the evacuation port 112. The atomic beam generator 10 is disposed at a position where the atomic beam can be bombarded to the wafer W placed on the placement stage 120.

In this surface modification method, for a start, the wafer W is set on the placement stage 120, and the inside of the chamber 110 is evacuated to create a vacuum environment. At that time, the inside of the chamber 110 and the inside of the atomic beam generator 10 are set to predetermined pressures by introducing argon gas into the atomic beam generator 10 while adjusting discharge of the gas through the evacuation port 112. The pressure inside the chamber 110 is preferably about 1 Pa, for example, and the pressure inside the atomic beam generator 10 is preferably 3 Pa or higher. The pressure inside the atomic beam generator 10 is determined depending on a pressure loss caused by the irradiation ports 23, an amount of the introduced argon gas, and pressure balance inside the chamber 110. Thus, the amount of the introduced argon gas may be adjusted, for example, such that the pressure inside the atomic beam generator 10 is set to 3 Pa or higher while the inside of the chamber 110 is kept at 1 Pa. The amount of the introduced argon gas when the pressure inside the atomic beam generator 10 is set to 4 Pa while the inside of the chamber 110 is kept at 1 Pa is about 60 sccm, for example. However, the suitable pressure and amount of the introduced argon gas may be changed as appropriate because they are different depending on the vacuum pumping capacity and the pressure loss caused by the irradiation ports.

Next, a high voltage is applied from the DC power supply between the cathode 20 and the anode 40 of the atomic beam generator 10. Upon the application of the high voltage, the plasma containing argon ions is generated in the atomic beam generator 10 by a high electric field between the cathode 20 and the anode 40, and thereafter the plasma is stabilized. The distance between the cathode 20 and the anode 40 of the atomic beam generator 10, the gas pressure inside the atomic beam generator 10, and the applied voltage are determined depending on a current set in advance. The current flows through electrons and the argons ions (Art and $Ar^{2+}$) in the plasma.

Because the argon ions contained in the plasma have positive charges, the argon ions radially move along the electric field from a central portion of an inner space of the cathode 20 toward the cathode 20. Among those argon ions, only a beam of the argon ions reaching the irradiation ports 23 is electrically neutralized ($Ar^{+}+e^{-}\rightarrow Ar$ and $Ar^{2+}+2e^{-}\rightarrow Ar$) by collision with the electrons in the vicinity of the irradiation ports 23, and is emitted as a beam of neutral atoms from the atomic beam generator 10. Here, electrons generated at an inner surface of the cathode 20 move toward the anode 40, but those electrons are forced to move toward the emission surface 22 by the actions of the magnetic fields B1 and B2 in accordance with the Fleming's left-hand rule (see FIG. 5). Argon ions attracted by charges of those electrons are guided to the emission surface 22. Eventually, the number of argon atoms emitted from the irradiation ports 23 increases. In such a manner, a larger number of the argon atoms can be bombarded with the atomic beam generator 10.

Thus, by irradiating the wafer with the atomic beam of the argon atoms from the atomic beam generator 10, oxides and so on formed on a wafer surface are removed, impurities adhering to the wafer surface are removed, the wafer surface is activated with decoupling of bonds, and/or the wafer surface is converted to an amorphous state. As a result, the wafer surface is modified and the surface modified body is obtained.

According to the above-described atomic beam generator 10 and the surface modification method using the atomic beam generator 10, since the first magnetic field B1 and the second magnetic field B2 being parallel to the emission surface 22 and oriented in the predetermined directions are generated, the electrons generated at the cathode 20 and moving toward the anode 40 are forced to move toward the emission surface 22 by the actions of the magnetic fields B1 and B2. The positive ions are attracted by the charges of those electrons and are guided to the emission surface 22. Eventually, a larger number of atoms can be emitted from the irradiation ports 23. Therefore, a processing time of the wafer W is shortened, and the surface of the wafer W can be modified efficiently. Moreover, since the positive ions are guided to the emission surface 22 by the actions of the magnetic fields B1 and B2, it is supposed that the positive ions colliding with the cathode 20 and the anode 40 can be reduced, and that the cathode 20 and the anode 40 can be suppressed from being sputtered. As a result, the life span of the atomic beam generator 10 can be prolonged, and the wafer can be suppressed from being contaminated with sputter particles that are generated by sputtering of the cathode 20 and the anode 40. In addition, it is deemed that since the magnetic fields B1 and B2 parallel to the emission surface 22 are generated, the position and the state of the plasma become appropriate and the number of the atoms emitted from the irradiation ports 23 can be increased.

Since the magnetic fields B1 and B2 are generated at positions away from the anode 40 in a sandwiching relation to the anode 40 when viewed from the side including the emission surface 22, the electrons generated at opposing portions of the cathode 20 sandwiching the anode 40 can be forced to move toward the emission surface 22 by the actions of the magnetic fields B1 and B2. As a result, the number of the atoms emitted from the irradiation ports can be further increased.

Since the magnetic field generating unit 60 is disposed within the inner space of the cathode 20 at a position closer to the emission surface 22, the number of the atoms emitted from the irradiation ports can be further increased.

Because of including the rod-shaped first anode 41 disposed at the position away from the emission surface 22 and the rod-shaped second anode 42 disposed at the position further away from the emission surface 22, a proportion of the electrons moving from the cathode toward the anode along paths substantially parallel to the emission surface 22 can be increased. As a result, the number of the atoms emitted from the irradiation ports can be further increased.

Furthermore, the anode 40 includes the rod-shaped first anode 41 and the rod-shaped second anode 42 that are disposed plane-symmetrically with respect to a predetermined imaginary plane P0 perpendicular to the emission surface 22, the axes of the first anode 41 and the second anode 42 are parallel to the imaginary plane P0, and the magnetic field generating unit 60 generates the first magnetic field B1 and the second magnetic field B2 in a sandwiching relation to the imaginary plane P0. Therefore, larger part of the electrons moving from the cathode toward the anode along the paths substantially parallel to the emission surface enters the first magnetic field and the second magnetic field, whereby a larger number of the electrons can be moved toward the emission surface. In addition, since the first anode 41 and the second anode 42 are disposed with their axes positioned on the imaginary plane P0, the electrons are moved toward the first anode 41 from opposing portions of the cathode 20 on both the sides of the first anode 41, and the electrons are moved toward the second anode 42 from opposing portions of the cathode 20 on both the sides of the second anode 42. As a result, a larger number of the electrons can be caused to enter the first magnetic field B1 and the second magnetic field B2.

Since a plane including the irradiation ports 23 is located at a position intersected by the imaginary plane P0, the positive ions guided to the emission surface 22 by the action of the first magnetic field B1 and the positive ions guided to the emission surface 22 by the action of the second magnetic field B2 are both guided to the vicinity of the irradiation ports 23. Accordingly, a larger number of the atoms can be emitted from the irradiation ports 23.

Moreover, when viewed from the side including the emission surface 22, the irradiation ports 23 are provided to cover a region between a linear line connecting the N pole of the first magnetic field generating unit 61 and the S pole of the second magnetic field generating unit 62 and a linear line connecting the S pole of the first magnetic field generating unit 61 and the N pole of the second magnetic field generating unit 62. It is inferred that a larger number of the positive ions are guided to such a region by the actions of the first magnetic field B1 and the second magnetic field B2, and hence that a larger number of the atoms can be emitted from the irradiation ports 23 with the arrangement in which the irradiation ports are provided in the above-mentioned region.

As a matter of course, the atomic beam generator and the surface modification method according to the present invention are not limited to the above-described embodiment, and they can be implemented in various forms insofar as falling within the technical scope of the present invention.

For example, the cathode 20 is not limited to the above-described one, and it may be constituted as appropriate depending on the shape, size and arrangement of the anode, the shape, size and arrangement of an irradiation target, and so on such that the plasma is stably generated in the desired region and the desired electric field for moving the electrons is formed. The anode 40 is also not limited to the above-described one, and it may be constituted as appropriate depending on the shape, size and arrangement of the cathode, the shape, size and arrangement of the irradiation target, and so on such that the plasma is stably generated in the desired region and the desired electric field for moving the electrons is formed. The expression "desired electric field" refers to an electric field causing the electrons to move under a situation in which the magnetic field generated by the magnetic field generating unit 60 effectively acts on the electrons.

While, in the above embodiment, the cathode 20 has been described as having the box-like shape, it may have a cylindrical shape, for example. When the cathode 20 has the cylindrical shape, the irradiation ports may be formed in a cylindrical surface or a bottom surface of a cylinder. The shape and size of the cathode 20 are preferably set to provide the inner space allowing the plasma to be stably generated in the desired region, and they may be set as appropriate depending on the shape, size and arrangement of the anode, the shape, size and arrangement of the irradiation target, and so on.

While, in the above embodiment, the cathode 20 has been described as being constituted by a metal-made and water-cooled jacket lined with the carbon material, the metal-made and water-cooled jacket may be omitted, or the material of the cathode may be other than the carbon material. The material other than the carbon material is preferably conductive and durable to sputtering of positive ions (for example, argon ions). Examples of that type of material are tungsten (W), molybdenum (Mo), titanium (Ti), nickel (Ni), and compounds and alloys of those elements. More specific examples are tungsten (W), a tungsten alloy (W alloy), tungsten carbide (WC), molybdenum (Mo), a molybdenum alloy (Mo alloy), and titanium boride (TiB). The surface of the carbon material of the cathode 20 may be coated with the above-mentioned material that is durable to the sputtering of the positive ions.

While, in the above embodiment, the irradiation ports 23 of the cathode 20 have been described as being formed in one surface of the cathode 20, the irradiation ports 23 may be formed in a plurality of surfaces of the cathode 20. While the irradiation ports 23 having a square shape have been described as being formed at equal intervals, the irradiation ports may have, for example, a circular, elliptic, or polygonal shape, and may not need to be formed at equal intervals. An irradiation distribution of the atomic beam can be changed by adjusting the shape of the irradiation ports and the interval between them.

While the above embodiment has been described mainly in connection with the case of introducing the argon gas into the cathode 20, the gas introduced into the cathode 20 is not limited to the argon insofar as the gas is able to form the plasma. However, the introduced gas is preferably inert gas. The inert gas is, for example, helium, neon, or xenon.

While, in the above embodiment, the anode 40 has been described as including the second anode 42 disposed at the position farther away from the emission surface 22 than the first anode 41, the first anode 41 and the second anode 42 may be disposed at positions away from the emission surface 22 through the same distance. In such a case, the first anode 41 and the second anode 42 are disposed at positions spaced from each other in the up-down direction. While the first anode 41 and the second anode 42 have been described as being parallel and overlapped with each other when viewed from the side including the emission surface 22, those anodes may not need to be parallel and/or overlapped with each other when viewed from the side including the emission surface 22. Furthermore, while the first anode 41 and the second anode 42 have been described as being disposed parallel to the emission surface 22, those anodes may be disposed perpendicularly to the emission surface 22 or obliquely relative to the emission surface 22. Moreover, while the axes of the first anode 41 and the second anode 42 have been described as being parallel to the imaginary plane P0, those axes may be disposed perpendicularly to the imaginary plane P0 or obliquely relative to the imaginary plane P0. While the first anode 41 and the second anode 42 have been described as being round rods, the sectional shape of each anode is not limited to a circle, and it may be elliptic or polygonal, for example, or a shape having an uneven surface. While the above description has been made as using two rod-shaped anodes, namely the first anode 41 and the second anode 42, the number of the rod-shaped anodes is not limited to a particular value.

Figure 8:
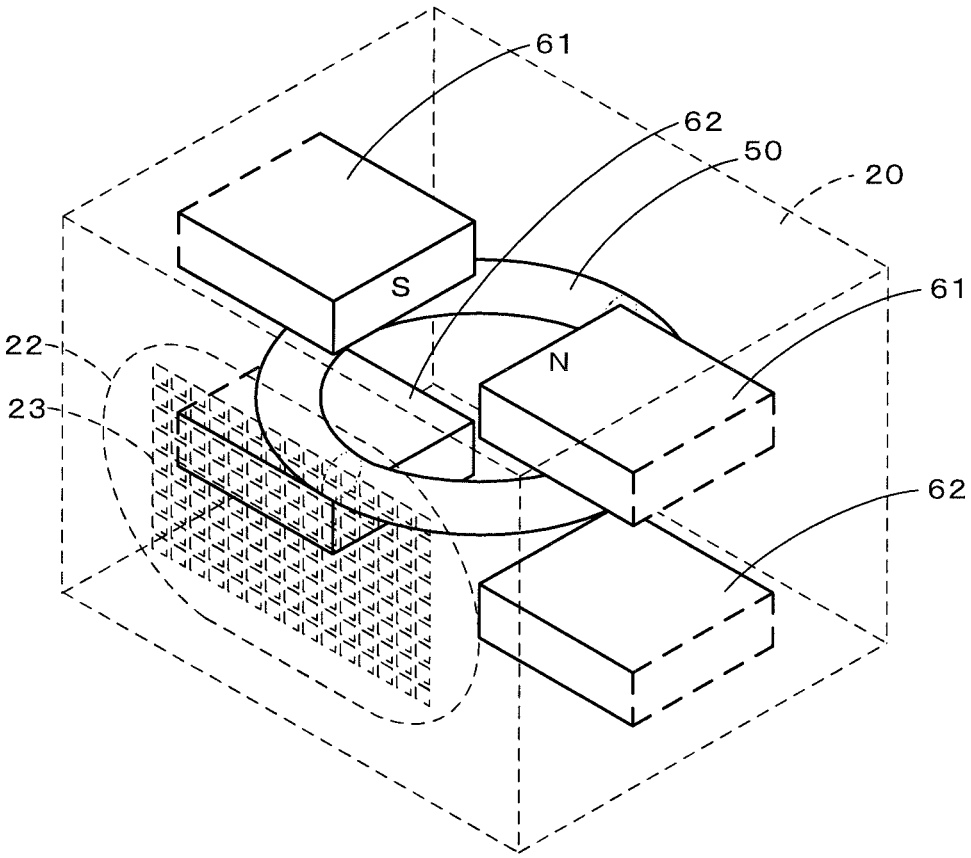
FIG. 8 is a schematic perspective view illustrating another example of the internal structure of the cathode 20.

While, in the above embodiment, the anode 40 has been described as including the rod-shaped first anode 41 and the rod-shaped second anode 42, the anode may be an annular anode 50 as illustrated in FIG. 8. In FIG. 8, the annular anode 50 is disposed horizontally such that one outer end of a ring in a diametrical direction is located at a position away from the emission surface 22 and the other outer end of the ring in the diametrical direction is located at a position further away from the emission surface 22. However, the annular anode 50 may be disposed vertically or obliquely. While FIG. 8 illustrates the case in which one and the other outer ends of the annular anode 50 in the diametrical direction overlap with each other when viewed from the side including the emission surface 22, both the ends may not need to overlap with each other when viewed from the side including the emission surface 22.

While, in the above embodiment, the anode 40 has been described as being made of the carbon material, the material of the anode may be other than the carbon material. The material other than the carbon material is preferably conductive and durable to sputtering of positive ions (for example, argon ions). Examples of that type of material are as per described above in connection with the cathode 20. The surface of the carbon material of the anode 40 may be coated with the above-mentioned material that is durable to the sputtering of the positive ions.

As another example, the magnetic field generating unit 60 is not limited to the above-described one, and it may be constituted as appropriate insofar as a magnetic field can be obtained which is parallel to the emission surface 22 and which acts to guide the positive ions produced inside the cathode 20 to the emission surface 22. The intensity of the magnetic field is just required to be able to change the motion of the electrons by a desired amount.

While, in the above embodiment, the magnetic field generating unit 60 has been described as including the first magnetic field generating unit 61 and the second magnetic field generating unit 62, a further magnetic field generating unit may be added. The intensities of the magnetic fields generated by the individual magnetic field generating units may be the same or different from one another. While the magnetic field generating unit 60 has been described as being disposed within the inner space of the cathode 20 at the middle between the emission surface 22 and a cathode surface on the opposite side, the magnetic field generating unit 60 may be disposed closer to the emission surface 22 or to the cathode surface on the opposite side to the emission surface 22. With the structure in which the magnetic field generating unit 60 is disposed closer to the emission surface 22, the number of the atoms emitted from the irradiation ports 23 can be further increased. While the magnetic field generating unit 60 has been described as generating the magnetic fields B1 and B2 parallel to the emission surface 22 in the sheath region 81, the magnetic fields B1 and B2 may be generated in the plasma region 80. In the case of generating the magnetic fields B1 and B2 in the plasma region 80, those magnetic fields are preferably generated in a suitable zone in FIG. 7, namely a zone close to the sheath region 81.

While, in the above embodiment, the magnetic field generating unit 60 has been described as being constituted by the yokes 63, an N pole and an S pole of magnets may be disposed at positions of the N-pole-side end portion and the S-pole-side end portion of each yoke, respectively, with omission of the yoke 63. Furthermore, the magnetic field generating unit 60 may include an electromagnet in place of the yoke 63 or the permanent magnet 69. In the case of using the electromagnet, the intensity of the magnetic field can easily be adjusted and can be changed over time. As a result, a more appropriate magnetic field can be applied depending on the voltage, the current, the gas amount, the pressure inside the cathode 20, and so on.

While, in the above embodiment, components of the magnetic field generating unit 60 other than the permanent magnet 69 of the yoke 63 have been described as being made of iron, materials of those components are not limited to particular ones insofar as they are magnetic substance. Those components may be made of steel, for example. While the permanent magnet 69 has been described as being a neodymium magnet, it may be a samarium-cobalt magnet or the like. However, the neodymium magnet is more preferable because it can apply a stronger magnetic field. On the other hand, when the temperature of the atomic beam generator 10 becomes as high as exceeding 300° C., the samarium-cobalt magnet having the high Curie temperature of 700 to 800° C. is more preferable.

While, in the above embodiment, the anode 40 and the magnetic field generating unit 60 have been described as being movable, they may be fixedly held.

While, in the above embodiment, the surface modification method has been described as modifying the wafer surface with the atomic beam generator 10, it is also possible to use the atomic beam generator 10 from which the magnetic field generating unit 60 is omitted. In that case, the wafer surface may be modified by generating, in the cathode 20, the magnetic fields B1 and B2 parallel to the emission surface 22 so as to guide the positive ions produced in the cathode 20 toward the emission surface 22 with a magnet, a magnetic field generation device, or the like which is prepared separately, and by irradiating the wafer with an atomic beam in the above state.

[Bonding Apparatus]

Figure 10:
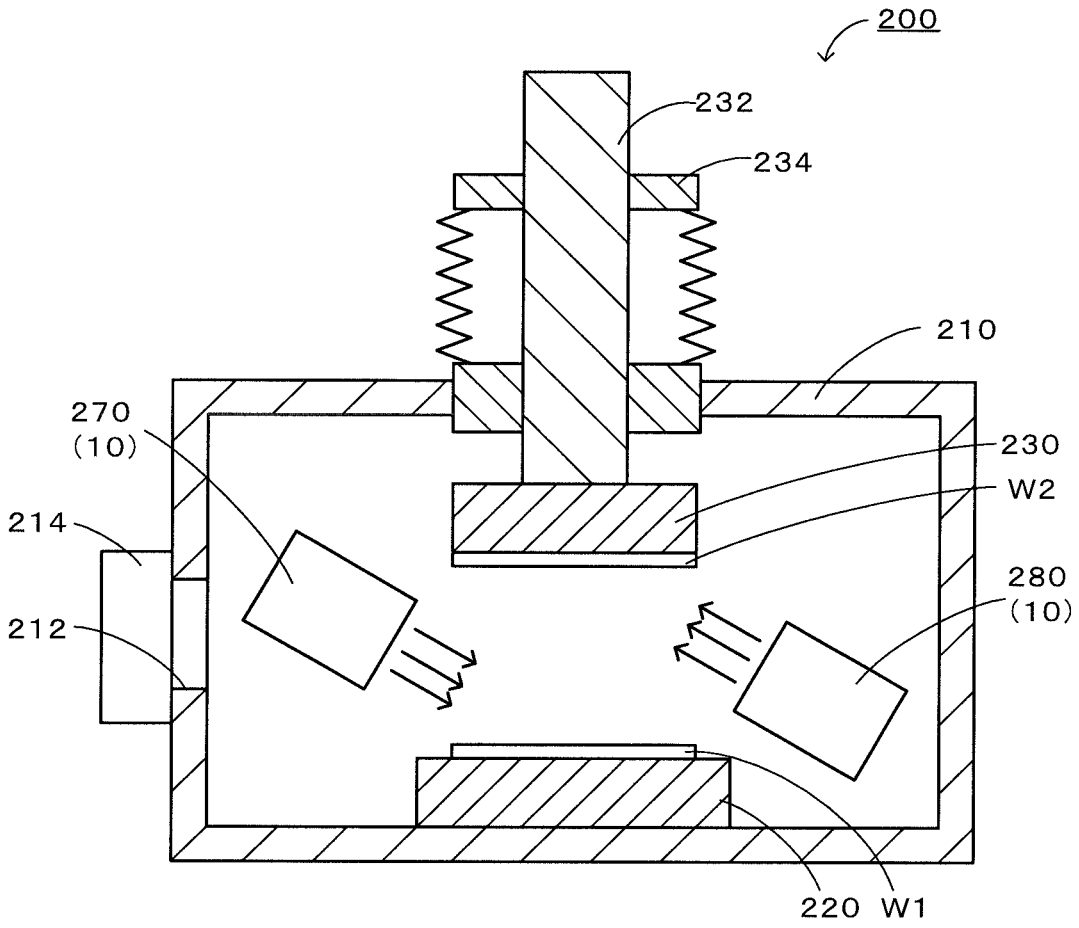
FIG. 10 is a schematic sectional view illustrating a structure of a bonding apparatus 200.

A bonding apparatus 200 using the atomic beam generator 10 will be described below. FIG. 10 is a schematic sectional view illustrating a structure of the bonding apparatus 200. The bonding apparatus 200 may be constituted as a room-temperature bonding apparatus.

The bonding apparatus 200 includes a chamber 210, a first placement stage 220, a second placement stage 230, a first atomic beam generator 270, and a second atomic beam generator 280.

The chamber 210 is a vacuum container the inside of which is sealed from an environment. The chamber 210 has an evacuation port 212 to which a vacuum pump 214 is connected to discharge gas inside the chamber 210 through the evacuation port 212.

The first placement stage 220 is disposed on a bottom surface of the chamber 210. The first placement stage 220 has a dielectric layer formed on its upper surface and is constituted as an electrostatic chuck that attracts a wafer W1 toward the dielectric layer by electrostatic force when a voltage is applied between the dielectric layer and the wafer W1.

The second placement stage 230 is disposed inside the chamber 210 at a position opposing to the first placement stage 220, and is supported to be vertically movably by a support member 232 that is connected to a pressure bonding mechanism 234. With the operation of the pressure bonding mechanism 234, the second placement stage 230 is moved from an irradiation position at which a wafer W2 is irradiated with an atomic beam to a bonding position at which the wafer W2 is pressed against and bonded to the wafer W1, or moved from the bonding position to the irradiation position. The second placement stage 230 has a dielectric layer formed on its lower surface and is constituted as an electrostatic chuck that attracts the wafer W2 toward the dielectric layer by electrostatic force when a voltage is applied between the dielectric layer and the wafer W2.

The first atomic beam generator 270 is constituted in a similar structure to that of the above-described atomic beam generator 10. The first atomic beam generator 270 is disposed at a position at which the atomic beam can be bombarded toward the wafer W1 placed on the first placement stage 220.

The second atomic beam generator 280 is constituted in a similar structure to that of the above-described atomic beam generator 10. The second atomic beam generator 280 is disposed at a position at which the atomic beam can be bombarded toward the wafer W2 placed on the second placement stage 230 when the second placement stage 230 is held at the irradiation position.

A bonding method of bonding the wafer W1 (first member) and the wafer W2 (second member), which are irradiation targets, (namely, a method of producing a bonded body) with the bonding apparatus 200 will be described below. The following description is made regarding the case in which atoms to be bombarded are argon atoms. The bonding method includes (a) a modifying step and (b) a bonding step.

(a) Modifying Step

In this step, for a start, the wafer W1 is set on the first placement stage 220, the wafer W2 is set on the second placement stage 230, and the inside of the chamber 210 is evacuated to create a vacuum environment. At that time, the inside of the chamber 210 and the insides of the first and second atomic beam generators 270 and 280 are set to predetermined pressures by introducing argon gas into the first and second atomic beam generators 270 and 280 while adjusting discharge of the gas through the evacuation port 212. The pressure inside the chamber and the pressures inside the first and second atomic beam generators 270 and 280 may be set as per explained in the above-described surface modification method.

Next, when the second placement stage 230 is not at the irradiation position, the second placement stage is moved to the irradiation position by the pressure bonding mechanism 234. A high voltage is then applied between the cathode 20 and the anode 40 in each of the first and second atomic beam generators 270 and 280 by using the DC power supply. The applied current and voltage may be set as per explained in the above-described surface modification method. Thus, a larger number of the argon atoms can be bombarded in each of the first and second atomic beam generators 270 and 280 as in the above-described surface modification method.

In such a manner, the wafer W1 placed on the first placement stage 220 is irradiated with the atomic beam from the atomic beam generator 270, and the wafer W2 placed on the second placement stage 230 is irradiated with the atomic beam of the argon atoms from the atomic beam generator 280. At wafer surfaces irradiated with the argon atoms, oxides and so on formed on the surfaces of the wafers W1 and W2 are removed, and/or impurities adhering to the surfaces of the wafers W1 and W2 are removed. As a result, the wafer surfaces are modified and surface modified bodies are obtained.

(b) Bonding Step

In this step, the pressure bonding mechanism 234 is operated to move the second placement stage 230 up to the bonding position, and the modified surfaces of the wafers W1 and W2 are brought into contact with each other. As a result, the first wafer W1 and the second wafer W2 are bonded and the bonded body is produced.

According to the above-described bonding apparatus 200 and the bonding method using the bonding apparatus 200, since the above-described atomic beam generator 10 and surface modification method are used, advantageous effects can be obtained which are similar to those obtained with them. Furthermore, according to the above-described surface modification method, since the surfaces of the first member and the second member can be modified in a shorter time, the first member and the second member can be bonded to each other with higher efficiency.

As a matter of course, the above-described bonding apparatus 200 and the bonding method using the bonding apparatus 200 are not limited to the above-described embodiments, and they can be implemented in various forms insofar as falling within the technical scope of the present invention.

For example, while the bonding apparatus 200 has been described as including two atomic beam generators, namely the first atomic beam generator 270 and the second atomic beam generator 280, the bonding apparatus may include only one atomic beam generator. In such a case, the surface modification of the wafer W1 and the surface modification of the wafer W2 may be successively performed by, for example, moving the atomic beam generator or moving at least one of the first and second placement stages 220 and 230. As an alternative, the bonding apparatus may include three or more atomic beam generators. The surface modification can be finished in a shorter time by performing the surface modification of one wafer with a plurality of atomic beam generators. When the surface modification of one wafer is performed with the plurality of atomic beam generators, the surface modification may be performed on a different region of the wafer surface with each of the atomic beam generators. Moreover, while the first atomic beam generator 270 and the second atomic beam generator 280 have been described as being constituted in a similar structure to that of the atomic beam generator 10, they may be constituted in a similar structure to that of the above-described atomic beam generator in the other form.

While, in the above embodiment, the bonding method has been described as bonding the wafer W1 and the wafer W2 with the bonding apparatus 200, the bonding apparatus 200 is not always required to be used. For example, while the modifying step has been described as modifying the surfaces of the wafers W1 and W2 with the atomic beam generators 270 and 280 each including the magnetic field generating unit 60, it is also possible to use the atomic beam generator from which the magnetic field generating unit 60 is omitted. In that case, the wafer surface may be modified by generating, in the cathode 20, the magnetic fields B1 and B2 parallel to the emission surface 22 so as to guide the positive ions produced in the cathode 20 toward the emission surface 22 with a magnet, a magnetic field generation device, or the like which is prepared separately, and by irradiating the wafer with an atomic beam in the above state. As another example, while the bonding step has been described as operating the pressure bonding mechanism 234 to move the second placement stage 230 up to the bonding position and bringing the modified surfaces of the wafers W1 and W2 into contact with each other, the modified surfaces of the wafers W1 and W2 may be brought into contact with each other without using the pressure bonding mechanism 234.

EXAMPLES

Examples of irradiating the wafer W with the atomic beam of the argon atoms by using the atomic beam generator 10 will be described below as EXAMPLES. It is needless to say that the present invention is not limited to the following EXAMPLES, and that the present invention can be implemented in various forms insofar as falling within the technical scope of the present invention.

1. Comparison with Atomic Beam Generator without Application of Magnetic Field

Example 1

Figure 11:
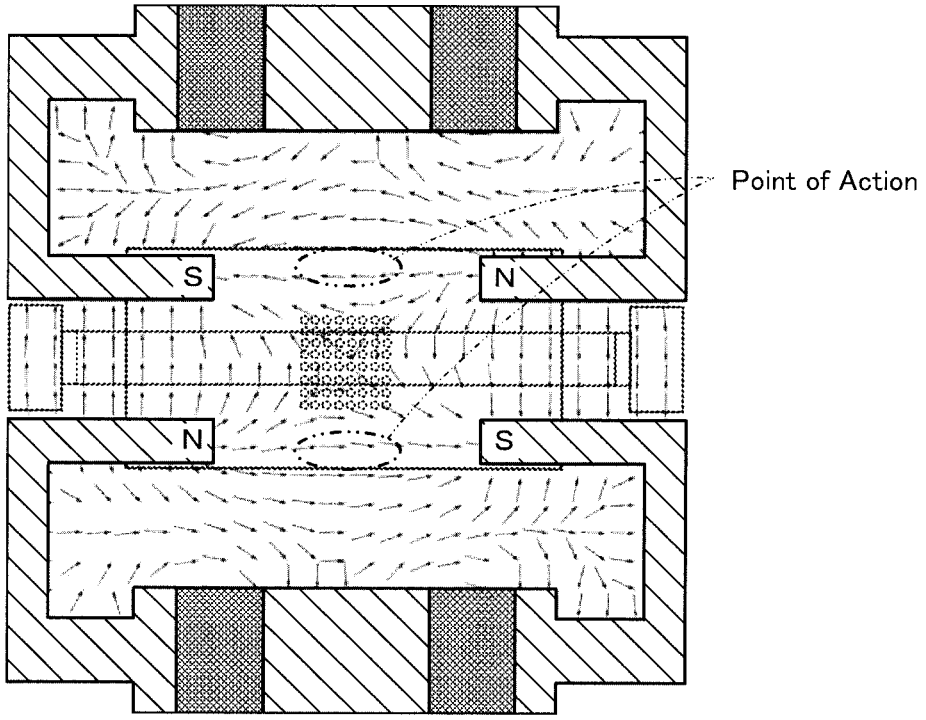
FIG. 11 illustrates a simulation result representing a state of lines of magnetic force.
Figure 12:
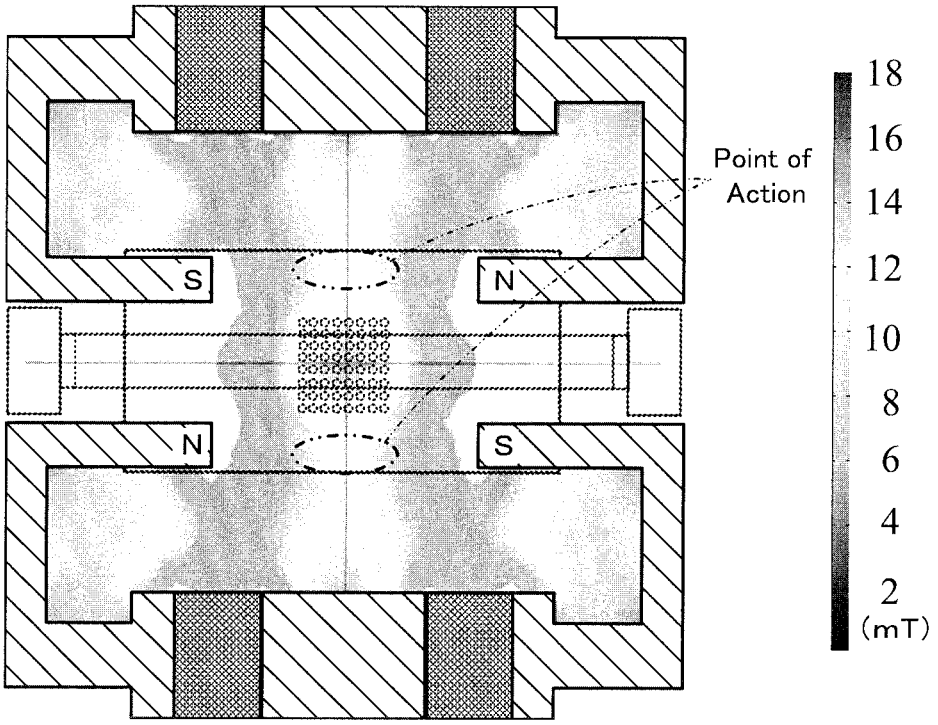
FIG. 12 illustrates a simulation result representing the intensity of a magnetic field.

An oxide-film removal profile was measured by, as illustrated in FIG. 9, irradiating the wafer W with the argon atomic beam in the chamber 110 by using the atomic beam generator 10 (see FIGS. 1 to 6). The wafer W was prepared by cutting out ¼ of a 4-inch Si wafer including an oxide film previously formed thereon, and was placed on a floor surface instead of the placement stage 120. The pressure inside the chamber was set to 1.2 Pa. The current and the voltage applied between the electrodes were set to 100 mA and 750 V, respectively. The flow rate of Ar was set to 80 sccm, and the irradiation time of Ar was set to 1 hour. Here, processing was performed in a state in which the atomic beam generator 10 and the placement stage 120 were kept fixed. In the yoke 63 in this EXAMPLE, the components other than the permanent magnet 69 were made of iron, and the permanent magnet 69 was made of neodymium of 450 mT. FIGS. 11 and 12 illustrate simulation results of a magnetic field generated in the atomic beam generator 10. FIG. 11 illustrates the simulation result representing a state of lines of magnetic force, and FIG. 12 illustrates a simulation result representing the intensity of the magnetic field. In FIG. 12, as denoted on the right side of the drawing, the magnetic field is expressed in darker shade as the magnetic field strengthens or weakens with the magnetic field of 10 mT being a reference. In FIG. 12, the magnetic field is weak in left and right end zones, a central zone, and zones positioned above and below the central zone and spaced from the central zone, whereas the magnetic field is strong in other zones. As a result of actually measuring the intensity of the magnetic field at the points of action with a tesla meter, the intensity was 25 to 40 mT. In EXAMPLE 1, an anode spacing P and an applied position Q of the magnetic field were set to be the same as those in EXAMPLE 2 described later.

Comparative Example 1

In COMPARATIVE EXAMPLE 1, an experiment was conducted on the same conditions as in EXAMPLE 1 except for using, instead of the atomic beam generator 10, the related-art atomic beam generator without application of the magnetic field. In the atomic beam generator used in EXAMPLE 1, the anode was constituted by disposing two anodes opposite to each other with a plane parallel to the emission surface sandwiched between the two anodes, but in the atomic beam generator used in COMPARATIVE EXAMPLE 1, the anode was constituted by disposing two anodes opposite to each other with a plane perpendicular to the emission surface sandwiched between the two anodes.

[Experimental Results]

Figure 13:
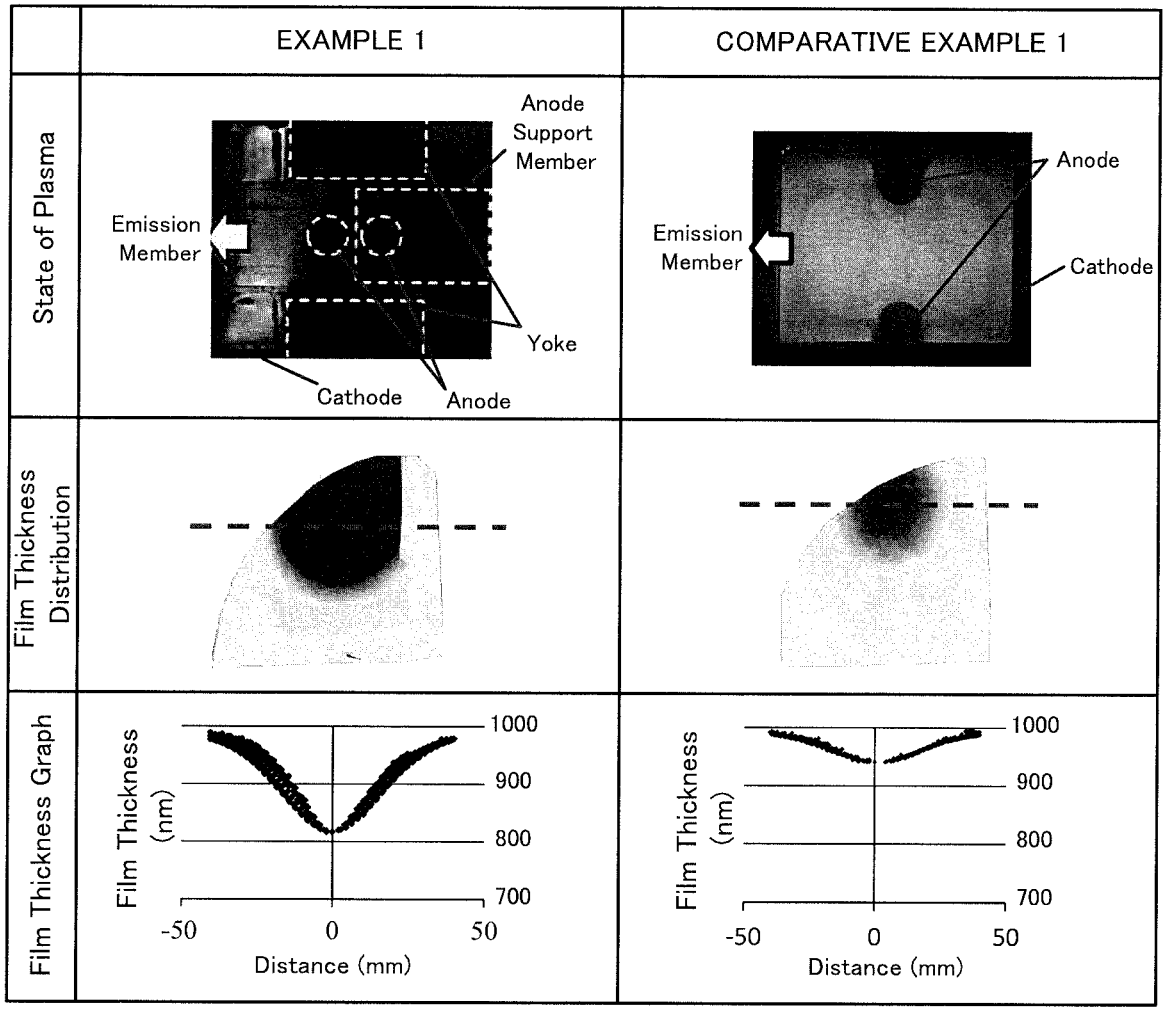
FIG. 13 illustrates experimental results of EXAMPLE 1 and COMPARATIVE EXAMPLE 1.

FIG. 13 illustrates experimental results of EXAMPLE 1 and COMPARATIVE EXAMPLE 1. A film thickness distribution represents a distribution of film thickness of the oxide film on the wafer W and indicates that a film thickness is thinner in a zone denoted by darker shade and a larger amount of the oxide film is removed there. A film thickness graph is a graph representing the film thickness of the oxide film on the wafer W at a section denoted by a dashed line in a plot of the film thickness distribution. As seen from FIG. 13, in EXAMPLE 1 with application of the magnetic field parallel to the plane including the emission surface, a larger amount of the argon atoms can be emitted from the emission surface and a larger amount of the oxide film can be removed than in COMPARATIVE EXAMPLE 1 without application of the magnetic field. It is inferred that, in the atomic beam generator 10, a larger number of the argon atoms can be emitted from the emission surface because the argon ions are attracted by charges of electrons $e^-$, which have been emitted from the cathode and of which motion direction has been changed by the magnetic field to be directed toward the emission surface, and those argon ions are moved toward the emission surface.

When the magnetic field is not applied, plasma is formed to be substantially symmetrical between the one anode side and the other anode side as in COMPARATIVE EXAMPLE 1. On the other hand, in EXAMPLE 1, plasma is formed on the side closer to the emission surface. This presumably indicates that a large number of the argon ions are present on the side closer to the emission surface. According to one view, the motion direction of the electrons $e^-$ is changed by the magnetic field to be directed toward the emission surface, the argon ions are attracted by those electrons, and/or the argon atoms are ionized by collision with those electrons, whereby a concentration of the argon ions is increased on the side closer to the emission surface. Thus, it is deemed that, in EXAMPLE 1, since the large number of the argon ions are present on the side closer to the emission surface, the large number of the argon atoms can be emitted from the emission surface. Although, in the plot representing the state of the plasma in EXAMPLE 1, the plasma is partly hidden behind the yokes and the anode support members and the entirety of the plasma does not appear, it can be said that the plasma is formed closer to the emission surface because the plasma hardly appear in upper zones on the left and right sides where the yokes and the anode support members are not present.

2. Examination of Anode Spacing and Applied Position of Magnetic Field

Examples 2 to 10

An oxide-film removal profile was measured by, as illustrated in FIG. 9, irradiating the wafer W, placed on the placement stage 120, with the argon atomic beam in the chamber 110 by using the atomic beam generator 10. A 3-inch Si wafer including an oxide film previously formed thereon was used as the wafer W. The pressure inside the chamber was set to 1.2 Pa. The current applied between the electrodes was set to 100 mA, the flow rate of Ar was set to 80 sccm, and the irradiation time of Ar was set to 1 hour. As a result of actually measuring the intensity of the magnetic field at the points of action with the tesla meter, the intensity was 25 to 40 mT. In EXAMPLE 2, the anode spacing P was set to 1 mm, and the yoke position Q (namely, the applied position of the magnetic field) was set to −15 mm. The anode spacing P represents a distance between the anodes when they are positioned closest to each other. The yoke position Q represents a center position of the yoke. Assuming the center of the inner space of the cathode to be a reference (0 mm), the yoke position Q is expressed by a minus value when positioned on the side closer to the emission surface, and by a plus value when positioned on the opposite side to the emission surface.

In EXAMPLE 3, the conditions were set to be the same as those in EXAMPLE 2 except for that the anode spacing P was set to 18 mm. In EXAMPLE 4, the conditions were set to be the same as those in EXAMPLE 2 except for that the anode spacing P was set to 32 mm.

In EXAMPLE 5, the conditions were set to be the same as those in EXAMPLE 2 except for that the yoke position Q was set to 0 mm. In EXAMPLE 6, the conditions were set to be the same as those in EXAMPLE 5 except for that the anode spacing P was set to 18 mm. In EXAMPLE 7, the conditions were set to be the same as those in EXAMPLE 5 except for that the anode spacing P was set to 32 mm.

In EXAMPLE 8, the conditions were set to be the same as those in EXAMPLE 2 except for that the yoke position Q was set to +15 mm. In EXAMPLE 9, the conditions were set to be the same as those in EXAMPLE 8 except for that the anode spacing P was set to 18 mm. In EXAMPLE 10, the conditions were set to be the same as those in EXAMPLE 8 except for that the anode spacing P was set to 32 mm.

[Experimental Results]

Figure 14:
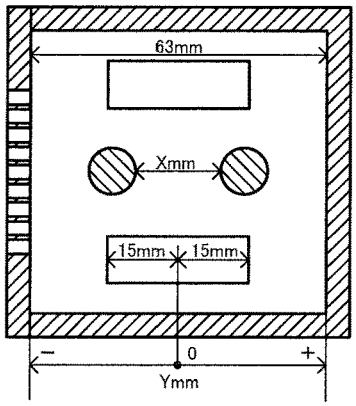
FIG. 14 is an explanatory view indicating an anode interval P and a yoke position Q in EXAMPLES 2 to 10.

FIG. 14 is an explanatory view indicating the anode interval P and the yoke position Q in EXAMPLES 2 to 10, FIG. 15 illustrates distributions of a processing depth of the wafer W in EXAMPLES 2 to 10, and FIG. 16 illustrates graphs of the processing depth of the wafer W in EXAMPLES 2 to 10.

In FIG. 15, as denoted in a lower right corner of the drawing, assuming a center value of the processing depth to be 50, the processing depth is expressed in darker shade as it decreases from the center value (namely, comes closer to 0) or increases from the center value (namely, comes closer to 100). Because the atomic beam is bombarded toward a central zone of the wafer W, the processing depth is deeper toward the central zone of the wafer W in FIG. 15. Furthermore, FIG. 16 represents the processing depths at an X section and a Y section denoted in a lower right corner. There is no significant difference between both the processing depths.

As seen from FIGS. 14 to 16, the processing depth is different depending on the anode spacing P and the yoke position Q. As also seen, among EXAMPLES 2 to 10, EXAMPLE 2 in which the anode spacing P is minimum and the yoke position Q is located on the side closer to the emission surface is preferable because the larger number of the argon atoms can be emitted. Regarding EXAMPLES 2 to 7 in which the yoke position Q is located on the side closer to the emission surface or at the center, it is seen that the anode spacing P is preferably set to be shorter because the larger number of the argon atoms can be emitted. On the other hand, regarding EXAMPLES 8 to 10 in which the yoke position Q is located at the position spaced from the emission surface, it is seen that the anode spacing P is preferably set to about 18 mm because the larger number of the argon atoms can be emitted.

The present application claims priority from Japanese Patent Application No. 2018-084961, filed on Apr. 26, 2018, the entire contents of which are incorporated herein by reference.

What is claimed is:

1. An atomic beam generator comprising:

a cathode constituted as a housing having an emission surface provided with an irradiation port through which an atomic beam is emissive;

an anode disposed inside the cathode to generate plasma between the cathode and the anode; and a magnetic field generating unit including a first magnetic field generating unit that generates a first magnetic field and a second magnetic field generating unit that generates a second magnetic field, and guiding positive ions produced in the cathode to the emission surface by generating, in the cathode, the first magnetic field and the second magnetic field both parallel to the emission surface such that a magnetic field direction is leftward in the first magnetic field and is rightward in the second magnetic field when viewed from an emission surface side on condition of the first magnetic field being positioned above the second magnetic field.

2. The atomic beam generator according to claim 1, wherein the magnetic field generating unit generates the first magnetic field and the second magnetic field at positions away from the anode in a sandwiching relation to the anode when viewed from the emission surface side.

3. The atomic beam generator according to claim 1, wherein the magnetic field generating unit is disposed within an inner space of the cathode at a position closer to the emission surface.

4. The atomic beam generator according to claim 1, wherein the anode is disposed plane-symmetrically with respect to a predetermined imaginary plane perpendicular to the emission surface, and the magnetic field generating unit generates the first magnetic field and the second magnetic field in a sandwiching relation to the imaginary plane.

5. The atomic beam generator according to claim 4, wherein the anode includes a rod-shaped first anode and a rod-shaped second anode, and axes of the first anode and the second anode are parallel to the imaginary plane.

6. The atomic beam generator according to claim 5, wherein the first anode and the second anode are disposed with the axes positioned on the imaginary plane.

7. The atomic beam generator according to claim 5, wherein the axes of the first anode and the second anode are parallel to the emission surface.

8. The atomic beam generator according to claim 4, wherein the irradiation port is provided at a position intersected by the imaginary plane.

9. The atomic beam generator according to claim 4, wherein, when viewed from the emission surface side, the irradiation port is provided between a linear line connecting an N pole of the first magnetic field generating unit and an S pole of the second magnetic field generating unit and a linear line connecting an S pole of the first magnetic field generating unit and an N pole of the second magnetic field generating unit.

10. The atomic beam generator according to claim 1, wherein the anode includes a rod-shaped first anode disposed at a position away from the emission surface and a rod-shaped second anode disposed at a position further away from the emission surface.

11. A bonding apparatus including the atomic beam generator according to claim 1.

12. A surface modification method carried out using an atomic beam generator comprising:

a cathode constituted as a housing having an emission surface provided with an irradiation port through which an atomic beam is emissive; and an anode disposed inside the cathode to generate plasma between the cathode and the anode, wherein the surface modification method modifies a surface of an irradiation target by irradiating the irradiation target with the atomic beam in a state in which a first magnetic field and a second magnetic field both parallel to the emission surface are generated in the cathode such that, in order to guide positive ions produced in the cathode to the emission surface, a magnetic field direction is leftward in the first magnetic field and is rightward in the second magnetic field when viewed from the emission surface side on condition of the first magnetic field being positioned above the second magnetic field.

13. A bonding method comprising steps of:

modifying surfaces of a first member and a second member, each being the irradiation target, by the surface modification method according to claim 12; and bonding the first member and the second member by bringing the modified surfaces into contact with each other.

* * * * *